United States Patent [19]

Poloni et al.

[11] Patent Number: 4,907,437

[45] Date of Patent: Mar. 13, 1990

[54] UNIVERSAL ROLLING STAND WITH ROLLING RINGS SUPPORTED AS CANTILEVERS

[75] Inventors: Alfredo Poloni, Ronchi Dei Legionari; Fausto Drigani, Zugliano, both of Italy

[73] Assignee: Danieli & C. Officine Meccaniche SpA, Buttrio, Italy

[21] Appl. No.: 123,722

[22] Filed: Nov. 23, 1987

[30] Foreign Application Priority Data

Nov. 24, 1986 [IT] Italy ..... 83444 A/86

[51] Int. Cl.[4] ..... B21B 13/00; B21B 31/04

[52] U.S. Cl. ..... 72/225; 72/238; 72/239

[58] Field of Search ..... 72/225, 237, 238, 239, 72/226, 249

[56] References Cited

U.S. PATENT DOCUMENTS

| | | | |
|---|---|---|---|
| 3,319,450 | 5/1967 | Bond | 72/238 |
| 3,938,362 | 2/1976 | Falk et al. | 72/225 |
| 3,949,586 | 4/1976 | Neumann | 72/238 |
| 4,557,130 | 12/1985 | Bond | 72/238 X |
| 4,581,911 | 4/1986 | Shinomoto | 72/35 |
| 4,653,304 | 3/1987 | Feldman et al. | 72/239 |
| 4,706,484 | 11/1987 | Dittmar et al. | 72/238 X |
| 4,706,485 | 11/1987 | Gilvar et al. | 72/239 |

FOREIGN PATENT DOCUMENTS

| | | |
|---|---|---|
| 0142879 | 10/1984 | European Pat. Off. . |
| 1118724 | 6/1962 | Fed. Rep. of Germany . |
| 2025640 | 12/1970 | Fed. Rep. of Germany . |
| 1937368 | 2/1972 | Fed. Rep. of Germany . |
| 8425635 | 2/1986 | Fed. Rep. of Germany . |
| 1545751 | 10/1968 | France . |
| 1508599 | 4/1978 | United Kingdom . |

*Primary Examiner*—W. Donald Bray

*Attorney, Agent, or Firm*—Wegner & Bretschneider

[57] ABSTRACT

Universal rolling stand with horizontal rolling rings supported as cantilevers on the mill stand, to the front of which stand is fitted a universal device (13) that forms a compact unit, pre-assembled and pre-positioned, comprising horizontal rolling rings (12), means (30) to secure the horizontal rings, vertical rolling rings (23) and equipment (33) to guide the rolled stock.

13 Claims, 3 Drawing Sheets

FIG. 2a
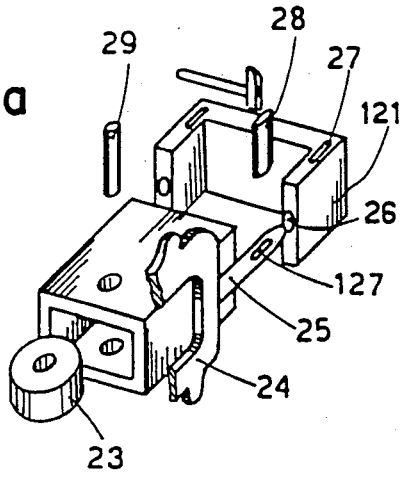
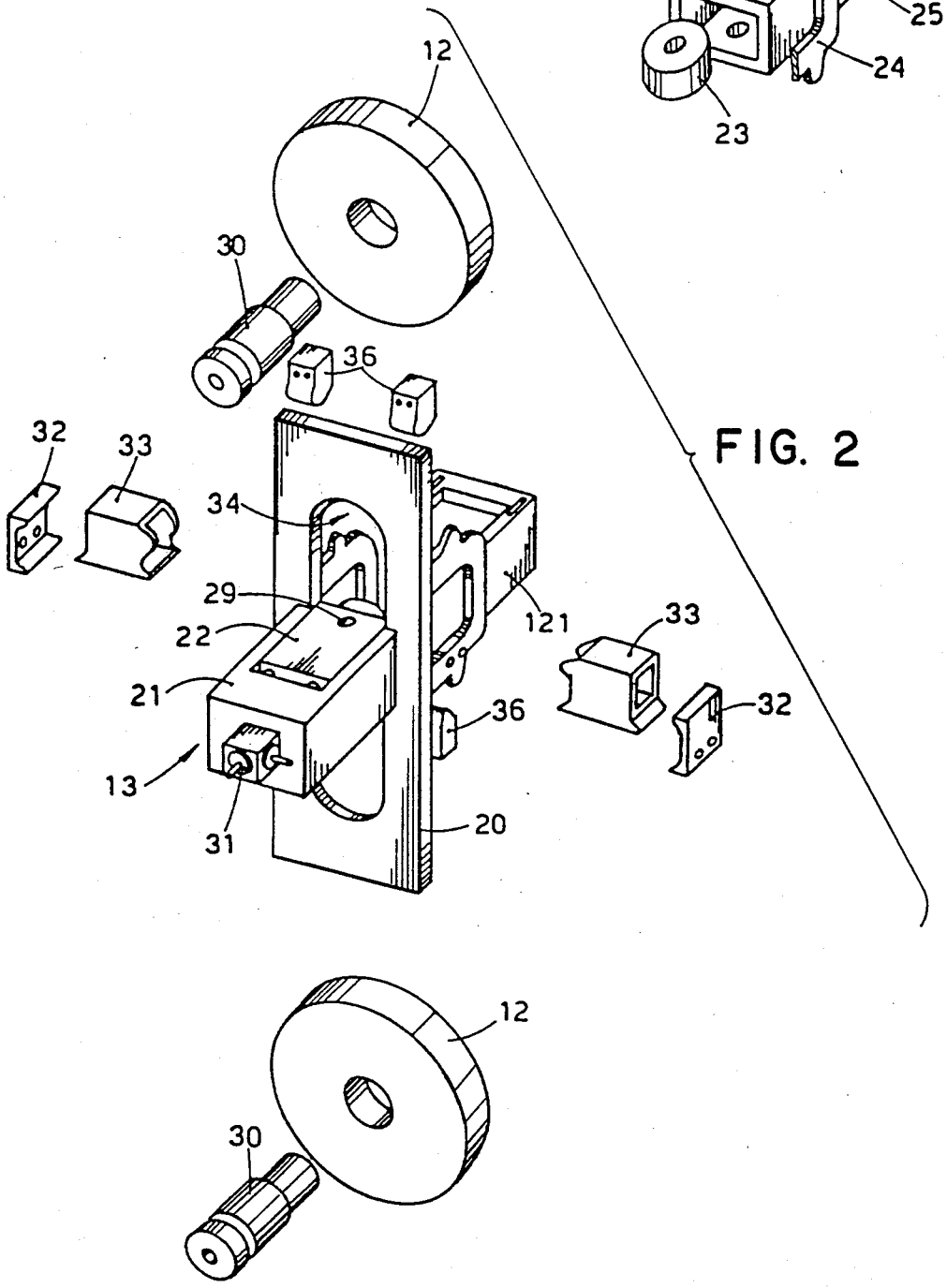
FIG. 2

UNIVERSAL ROLLING STAND WITH ROLLING RINGS SUPPORTED AS CANTILEVERS

BACKGROUND OF THE INVENTION

This invention relates to a rolling stand with horizontal rolling rings supported as cantilevers. Such a rolling stand is known from DE-U-No. 8425635. To be more exact, the invention provides a duo rolling stand with horizontal rings supported as cantilevers which is able to be converted into a universal rolling stand. The invention provides means to perform such conversion.

Unlike duo rolling stands having only horizontal rolls, universal stands comprise also vertical rolls or rings.

The part of the stands which supports the horizontal rolls is like a normal duo stand containing cantilevered horizontal rolls, whereas the vertical rolls or rings are fitted to slider means which enable the vertical rolls or rings to be correctly positioned.

The vertical rolls or rings may be freely turning or be driven.

Universal stands are also employed in rolling trains producing slabs and in rolling mills producing wide-flanged and parallel-flanged beams.

However, the known universal stands entail a series of drawbacks such as great volume, heavy weights, maintenance problems, complex operations to replace, adjust and time the rolls and rings and lengthy periods for regulating and timing the stands, such drawbacks rendering desirable the replacement of such stands with other more practical and compact equipment.

SUMMARY OF THE INVENTION

According to the invention a stand with rolling rings supported as cantilevers is provided;

According to the invention a support is also provided which can be fitted to the front part of the stand. This support is equipped to accommodate, support and position rolling rings which have a vertical axis and are suitable to cooperate with horizontal rolling rings of the stand in a required position in relation to those horizontal rings.

According to the invention this support is suitable for the pre-assembly, either in a workshop or in suitable working stations, of rolling rings with a vertical axis, rolling rings with a horizontal axis and of the necessary miscellaneous equipment, thus providing a compact assemblage with all the components already pre-positioned and fitted together so far as possible.

The outcome of this is that the exchange and replacement operations on the actual stand become very simple and few in number and require only very short times for their completion since the assemblage only has to be secured and clamped in position.

Moreover, the horizontal rolling rings may be embodied as simple rings without any protrusion or special abutment, thus obtaining a great saving.

According to the invention the stand comprises installation means suitable to assist the positioning and assembly and also the dismantling of such support when fitted to the stand.

According to one embodiment of the invention the stand is equipped to provide the support with motion means to adjust the positioning of the vertical rolling rings.

In another embodiment of the invention the stand is independently equipped with motors to perform the required actuations and positionings.

The invention is therefore embodied with a universal rolling stand with horizontal rolling rings supported as cantilevers on the mill stand.

BRIEF DESCRIPTION OF THE DRAWINGS

The attached figures, which are given as a non-restrictive example, show the following:

FIG. 2 gives a breakaway view of the essential components of the stand of FIG. 1;

FIG. 2*a* gives a breakaway view of the rear guide box;

DESCRIPTION OF THE PREFERRED EMBODIMENT

Figure 1:
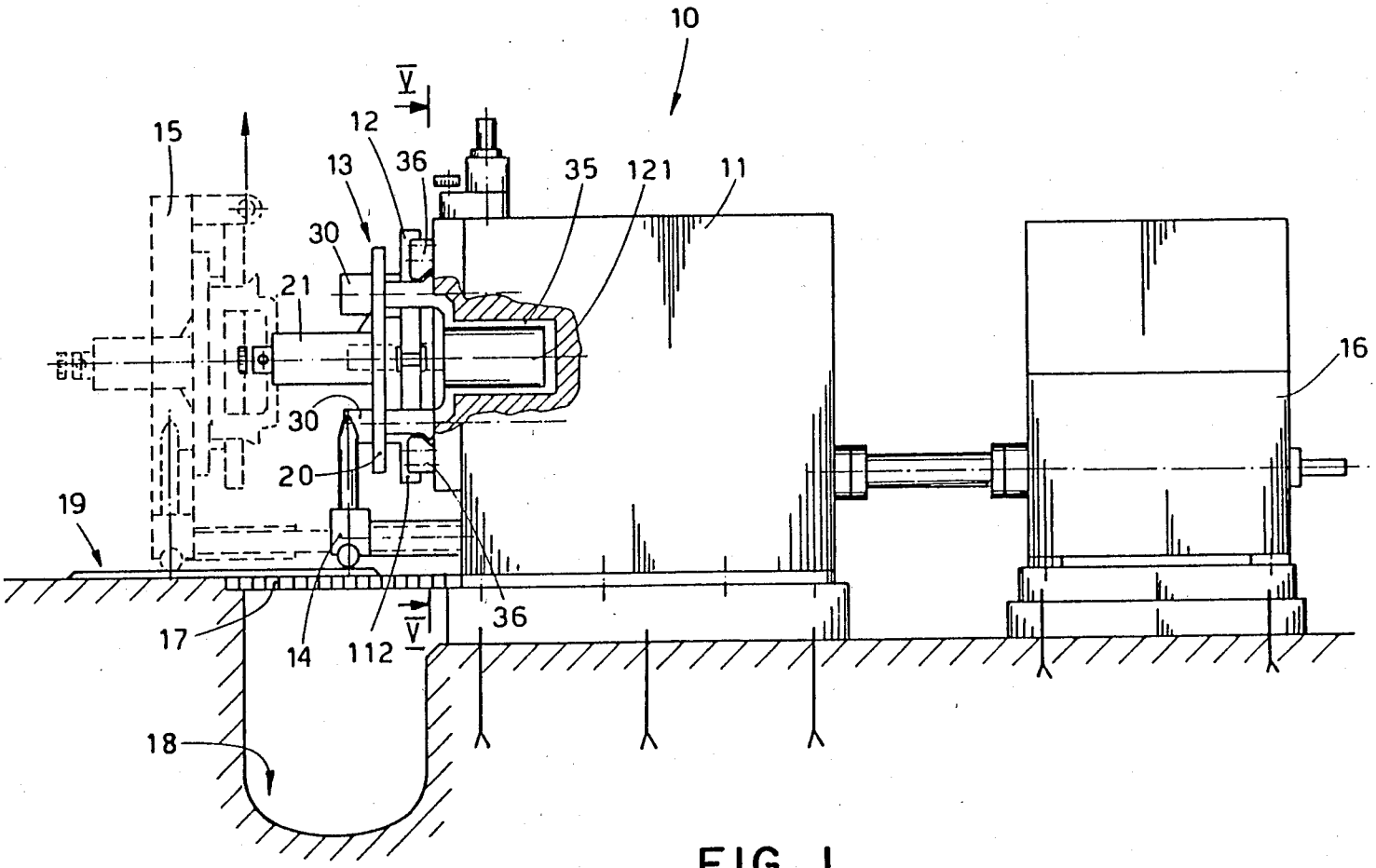
FIG. 1 gives a side view of one embodiment of a universal rolling stand with horizontal rolling rings supported as cantilevers.
Figure 3:
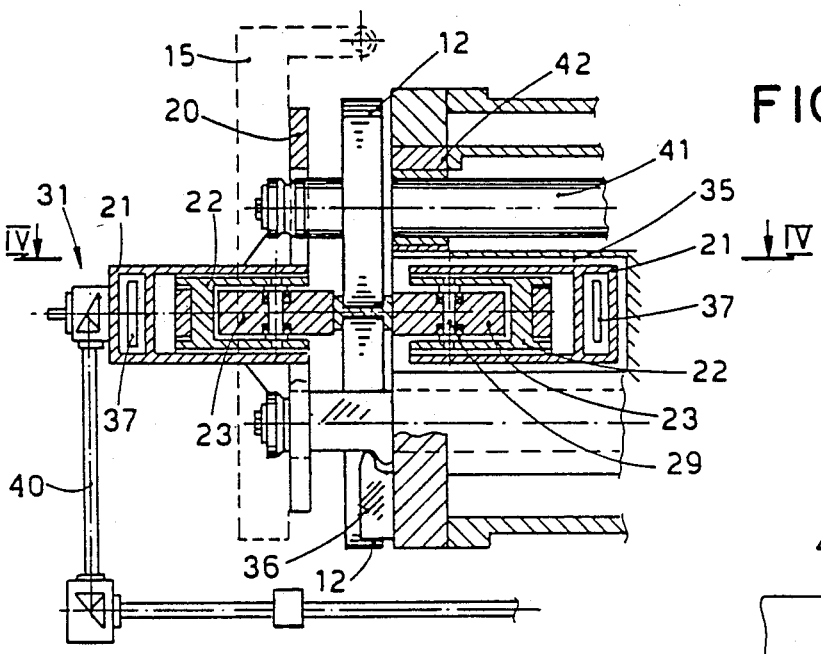
FIG. 3 shows a partial vertical section of the embodiment of FIG. 1.
Figure 5:
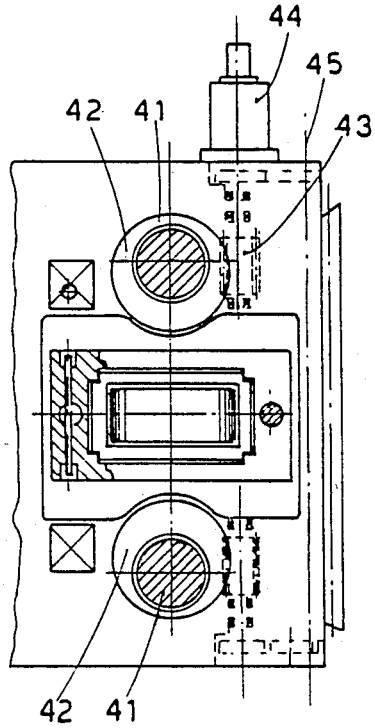
FIG. 5 shows a frontal vertical section V—V of FIG. 1.
Figure 4:
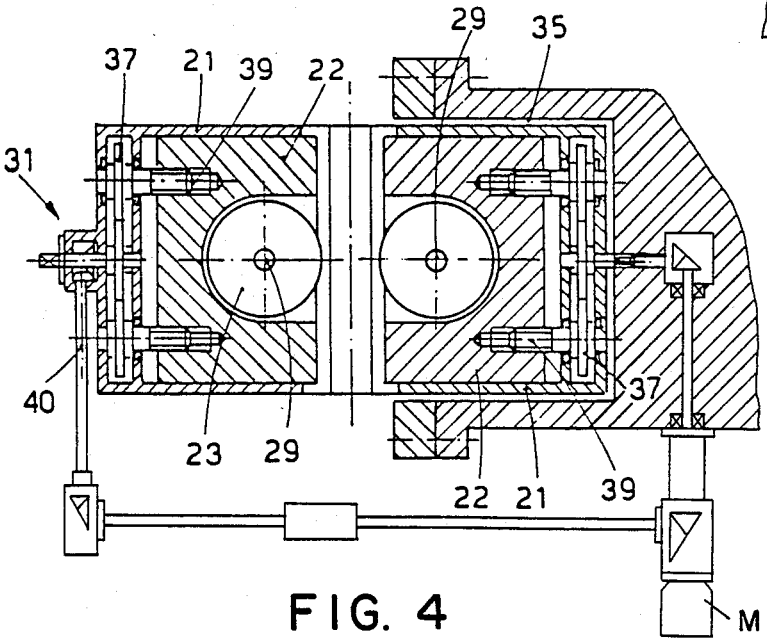
FIG. 4 gives a view of the section IV—IV of FIG. 3.

In the attached figures a universal stand 10 with rolling rings 12 supported as cantilevers comprises a drive unit 11 actuated by a motor 16.

A grating 17 and discharge channel 18 are provided in cooperation with the stand 10.

The stand 10 comprises an assembly unit 14 cooperating with guides 19 and an installation system 15.

The assembly unit 14 is known in itself, as also is the installation system 15 as regards its general structuring.

In the example shown, between shafts 41 which transmit motion to the rings 12, the drive unit 11 includes a space 35 able to hold part of, and to position, a universal device 13.

This universal device 13 together with vertical rolling rings 23, horizontal rolling rings 12 and pre-assembled guide equipment 33 for rolled stock cooperates with the installation system 15 and assembly unit 14 for installation on and removal from the drive unit 11.

Pre-assembly of the various components on the universal device 13 is carried out at suitable work stations off the processing line so as to avoid stoppages of work.

The universal device 13 is positioned and fixed to the drive unit 11 by means of positioning brackets 24 but is clamped to the drive unit 11 by catches 36 which act on the brackets 24.

This enables the installation and dismantling of the universal device 13 to be carried out very simply and speedily without any need to perform adjustments and timing since the adjustments and timing have already been carried out during pre-assembly of the components on the assembly bench.

The horizontal rings 12, which according to the invention are simple rings without any lateral protrusions, are fixed to shafts 41 by clamping pins 30, which too are pre-assembled on the universal device 13.

According to the invention the universal device 13 with its various pre-assembled and pre-positioned components forms a compact pre-assembled and pre-positioned unit which can be installed on, and dismantled from, the rolling stand by means of one single operation.

In the example shown the adjustment of the gap between centres of the horizontal rolls 12 is obtained by acting with an adjustment motor 44 on a worm screw 43 that actuates an eccentric support 42; a transmission shaft 45 is provided to transmit the motion to a worm screw that actuates an eccentric support on the other side of the roll shaft.

The universal device 13 comprises a support and guide plate 20 having cutaway portions 34 cooperating laterally with the pin 30 which clamps the horizontal rings 12. This support and guide plate 20 may also be replaced by a stiffening bridge or another means suitable for the purpose.

A guide box 21 is included on one side of the plate 20, whereas positioning brackets 24 are fixed to the other side of the plate.

The positioning brackets 24 comprise advantageously a support pin 25 able to cooperate with a hole 26 located in a removable guide box 121.

The removable guide box 121 is made removable so as to assist access and replacement of parts.

In this case the anchorage of the removable guide box 121 to the support pin 25 is obtained by a wedge 28 that cooperates with slots 27 and 127 respectively.

The guide boxes 21–121 support and guide lengthwise the housings 22 that bear the vertical rings 23.

The vertical rings 23 are supported rotatably by shafts 29 and consist substantially of rings without any lateral protrusions.

Lengthwise positioning of the housings 22 is obtained with an adjustment screw 39 actuated by toothed wheels, to which the motion is transmitted from a transmission unit 31 in this case.

The rolled stock guide equipments 33, which are clamped in the required position by locking plates 32 during pre-assembly, are positioned correctly in the positioning brackets 24.

One transmission unit 31 or an equivalent means is provided for each guide box 21. Motion can be transmitted to the transmission units 31 by a drive chain 40 having one single motive source.

The transmission units 31 may also possess independent motors (M).

The invention can be applied also to cantilever rolling stands with vertical rolls instead of cantilevered horizontal rolling rings and to rolling stands with inclined rolls instead of cylindrical rolls.

We claim:

1. In a universal rolling stand comprising a mill stand and horizontal rolling rings removably mounted on shafts supported as cantilevers on one side of said mill stand, the improvement comprising a pre-assembled and pre-positioned universal device removably mounted to said one side of said mill stand and comprising horizontal rolling rings, means to secure said horizontal rings onto said shafts, vertical rolling rings, and means to guide rolled stock.

2. Universal rolling stand as claimed in claim 1, wherein the horizontal rings are smooth rings without any protrusions.

3. Universal rolling stand as claimed in claim 1, wherein the pre-assembled and pre-positioned universal device is adapted to be removed or replaced in one single operation.

4. Universal rolling stand as claimed in claim 1, which further comprises shafts that transmit motion to the horizontal rings, and between said shafts a space within which the universal device extends partially.

5. Universal rolling stand as claimed in claim 1, in which the universal device comprises a support and guide plate which bears two guide boxes that guide housings which support vertical rings having their axis normal to the axis of the horizontal rings.

6. Universal rolling stand as claimed in claim 5, wherein said guide and support plate comprises positioning brackets.

7. Universal rolling stand as claimed in claim 5, wherein at least one of the guide boxes is adapted to be dismantled.

8. Universal rolling stand as claimed in claim 5, wherein, in which the rear guide box to be located in the space cooperates with pins comprised on the positioning brackets .

9. Universal rolling stand as claimed in claim 5, in which the housings that support the vertical rings are positioned lengthwise by adjustment screws governed by transmission units .

10. Universal rolling stand as claimed in claim 9, in which the transmission units are actuated by one single drive chain.

11. Universal rolling stand as claimed in claim 9, in which each transmission unit is actuated by its own motor.

12. Universal rolling stand as claimed in claim 6 wherein said universal device is fitted to the stand by clamping catches which cooperate with the positioning brackets.

13. In a universal rolling stand comprising a mill stand and horizontal rolling rings removably mounted on shafts supported as cantilevers on one side of said mill stand, the improvement comprising a preassembled and pre-positioned universal device removably mounted to said one side of said mill stand and comprising horizontal rolling rings, vertical rolling rings, and a support and guide plate which bears two guide boxes that guide housings which support said vertical rolling rings with their axis oriented normal to the axis of said horizontal rolling rings.

* * * * *